US008424862B2

(12) United States Patent
Campbell

(10) Patent No.: US 8,424,862 B2
(45) Date of Patent: Apr. 23, 2013

(54) COMPOSITE SUBSTRATE FEEDING MECHANISM

(75) Inventor: Richard Campbell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/224,023

(22) Filed: Sep. 1, 2011

(65) Prior Publication Data

US 2011/0309567 A1 Dec. 22, 2011

Related U.S. Application Data

(63) Continuation of application No. 12/188,541, filed on Aug. 8, 2008, now Pat. No. 8,028,985.

(51) Int. Cl.
*B65H 3/44* (2006.01)

(52) U.S. Cl.
USPC ..... 271/9.01; 271/145

(58) Field of Classification Search ..... 271/158, 271/9.01, 145; 270/28.19, 58.28
See application file for complete search history.

(56) References Cited

U.S. PATENT DOCUMENTS

| | | | | |
|---|---|---|---|---|
| 4,696,615 | A * | 9/1987 | Ettischer et al. | 414/795.8 |
| 2005/0211721 | A1 * | 9/2005 | Chirnomas et al. | 221/123 |
| 2006/0032902 | A1 * | 2/2006 | Kou | 235/376 |

* cited by examiner

*Primary Examiner* — Michael McCullough
*Assistant Examiner* — Howard Sanders
(74) *Attorney, Agent, or Firm* — Hoffmann & Baron, LLP

(57) ABSTRACT

Embodiments described herein include a composite feeding mechanism configured to process one or more jobs using a stack of feeder trays. The composite feeding mechanism can include the stack of feeder trays, a base unit, and a feeder unit. The feeder trays can hold substrate media to satisfy jobs and the base unit can support the stack of feeder trays. The feeder unit can remove the substrate media from a feeder tray located at the top of the stack to satisfy a job requirement.

18 Claims, 6 Drawing Sheets

COMPOSITE SUBSTRATE FEEDING MECHANISM

CROSS-REFERENCE TO RELATED APPLICATIONS

This application claims priority under 35 U.S.C. §120 of U.S. patent application Ser. No. 12/188,541, filed 8 Aug. 2008 by the present inventor, entitled COMPOSITE SUBSTRATE FEEDING MECHANISM, published 11 Feb. 2010 as U.S. Patent Application Publication No. 2010/0032886 A1, now allowed. The complete disclosure of this application is hereby incorporated by reference for all purposes.

BACKGROUND

1. Technical Field

The presently disclosed embodiments are directed to composite substrate feeding mechanisms having stackable feeder trays for holding a variety of substrate media.

2. Brief Discussion of Related Art

Conventional substrate feeders for use with printing systems generally include drawers for holding a predetermined size and quantity of paper. For example these drawers typically can hold between 550 and 3000 sheets of paper. These inflexible drawers limit the functionality of some printing systems. For example, because of the size of these drawers, only a limited number of drawers can be included in a substrate feeder. For long job runs such drawers provide an acceptable level of performance, since a user requires a larger number of sheets of paper to be available for each job run. However, for users who wish to perform shorter job runs, in some cases with more variability in job size, paper size, and paper type, these conventional substrate feeders can be burdensome and impractical.

Users typical implement "work arounds" so that these conventional substrate feeders function in a desired manner. For example, users may insert false loading material, such as cardboard, into a drawer of a substrate feeder to create a feeding jam at the end of a job run to stop the sheet feeding process so that the next job can be identified, prepared, and started. This mode of operation is not only inconvenient for the user, but also can lead to wear and tear of the substrate feeder and/or the printing system.

SUMMARY

According to aspects illustrated herein, there is provided a composite feeding mechanism. The composite feeding mechanism includes feeder trays, a base unit, and a feeder unit. The feeder trays hold substrate media and are stackable on each other. The base unit supports a stack of the feeder trays. The feeder unit removes the substrate media from a first one of the feeder trays located at the top of the stack to satisfy a job.

According to other aspects illustrated herein, there is provided a printing system. The printing system includes a composite feeding mechanism configured to process one or more jobs using a stack of feeder trays. The composite feeding mechanism is also configured to adjust a vertical position of the stack so that a top one of the feeder trays is selected to satisfy a first one of the one or more jobs and to separate the top one of the feeder trays from the stack from a remainder of the feeder trays in the stack after the first one of the one or more jobs is satisfied. The composite feeding mechanism is further configured to discharge the top one of the feeder trays after the top one of the feeder trays is separated from the stack.

According to further aspects illustrated herein, there is provided a method for satisfying jobs in a printing system. The method includes adjusting a vertical position of a stack of feeder trays to facilitate removal of substrate media from a top one of the feeder trays in the stack to satisfy a job and removing the substrate media from the top one of the feeder trays. The substrate media is used to generate printouts. The method also includes removing the top one of the feeder trays from the stack after the job is satisfied so that a subsequent job can be processed.

DETAILED DESCRIPTION

Exemplary embodiments include a composite feeding mechanism to enable multiple predefined job runs in a sequential manner. The composite feeding mechanism can include a base unit on which feeder trays can be stacked. A feeder unit can be configured to remove substrate media from the feeder trays for use in a printing job.

As used herein, a "composite feeding mechanism" refers a one or more devices that facilitate satisfaction of jobs in a printing system that may require different substrate media.

As used herein, a "printing system" refers to one or more devices used to generate "printouts", which refers to the reproduction of information on "substrate media". As used herein, "substrate media" refers to, for example, paper, transparencies, parchment, film, fabric, plastic, or other substrates on which information can be reproduced.

A printing system can use an "electrostatographic process" to generate printouts, which refers to forming and using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like.

As used herein, "feeder trays" refer to compartments for holding substrate media to be fed through a printing system.

As used herein, "stackable" refers to the ability to place feeder trays on top of other feeder trays to form a "stack", which refers to a substantially vertical column of feeder trays.

As used herein, a "base unit" refers to a device with a surface on which a stack of feeder trays can be placed so that the base unit supports the stack of trays.

As used herein, an "elevator module" refers to a device that can raise and/or lower a feeder tray or a stack of feeder trays in a substantially vertical direction.

As used herein, a "feeder unit" refers to a device that receives a stack of feeder trays and is configured to remove substrate media from the feeder trays to satisfy one or more jobs.

As used herein, the terms "job" and "run" are used interchangeably and refer to a process of printing or reproducing information on substrate media. Jobs or runs can use a predetermined amount of substrate media, where a "job size" or a "run size" refers to the amount of substrate media required for completing a job or run.

As used herein, "vertical" generally refers to a substantially up and down direction, where moving in the vertical direction can be considered moving in the direction of the gravitational force or against the gravitational force.

Figure 1:
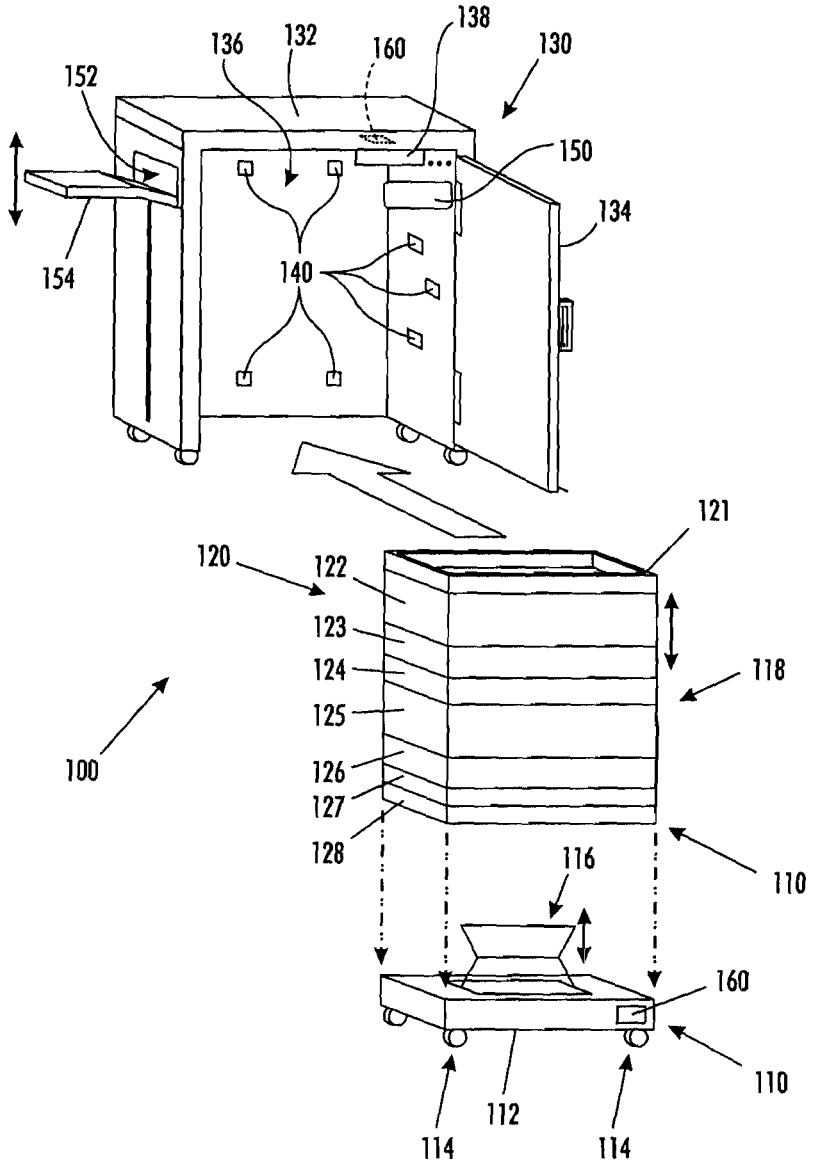
FIG. 1 illustrates an exemplary embodiment of a composite substrate feeding mechanism for use with a printing system.

FIG. 1 depicts an exemplary embodiment of a composite feeding mechanism 100 having a base unit 110, feeder trays 121-128 (collectively referred to herein as "feeder trays 120) ", and a feeder unit 130. The base unit 110 can provide a platform 112 for supporting a stack 118 of feeder trays 120. The base unit 110 can be portable and can be docked in, and removed from, the feeder unit 130. In some embodiments, the base 110 can be separate and distinct from the feeder unit 130 and in other embodiments can be integrated with and formed as part of the feeder unit 110. For embodiments where the base unit 110 is a separate and distinct unit, the base unit can be used with multiple feeder units 130. To allow the base unit 110 to move, the base unit can include castors 114 or other wheels on which the platform 112 can be supported. In some embodiment, a user can position the base 110 by manually pushing or pulling the base to the desired position. In other embodiments, the base can be positioned using a motor, such as an electric motor, that is controllable by the user using, for example, a remote control.

The base unit 110 can include an elevator module 116 that can be used to displace the feeder trays supported by the base unit 110 in a substantially vertical direction. The elevator module 116 can be used to shift the feeder trays 120 in an upward and/or downward direction. The elevator module 116 can be implemented as a hydraulic system, a pulley system, a pneumatic system, a gear system, and the like, and can be controlled manually using controls 160 disposed on at least one of the base unit 110 and the feeding unit 130, or by controls remote to the composite feeding mechanism. In some embodiments, the control of the elevator module 116 can be automated such that a computing device determines when to operate the elevator module 116.

The feeder trays 120 can be configured to hold substrate media. One or more of the feeder trays 120 can be configured to hold a specified amount, type, and/or size of substrate media. For example, one or more feeder trays 120 can be configured to hold 50 sheets of plain letter sized paper and one or more other trays can be configured to hold 100 sheets of plain A4 sized paper. In some embodiments, one or more of the feeder trays 120 can be adjustably configured to hold different amounts, types, and/or sizes of substrate media so that the feeder trays 120 can be flexibly configured based on a job to be performed.

The feeder trays 120 can be stacked to form a vertical column of feeder trays 120, which can be supported by the base unit 110. The feeder trays 120 can be configured to interface with each other so that the stack 118 of feeder trays 120 can be stably formed such that the feeder trays 120 are substantially fixed in their position in the stack. In this manner, the feeder tray 121 at the top of the stack 118 can be supported by the feeder tray 122 directly below, which in turn can be support by the feeder tray 123 directly below the feeder tray 122, and so on.

The feeder trays 120 can be preloaded with substrate media and stacked based on jobs to be performed. The stack 118 of feeder trays 120 can be arranged in an order corresponding to the order in which the jobs are to be performed. For example, feeder trays 121-128 can be stacked, where feeder tray 121 is at the top of the stack and corresponds to a first job to be performed, and feeder tray 128 is at the bottom of the stack and corresponds to a last job to be performed using the stack 118. In this manner, a user can load a number of feeder trays and form a number of stacks, which can be used to satisfy jobs. In addition, while a stack (of feeder trays) is being used to satisfy jobs, a user can begin preparing another stack of feeder trays for subsequent jobs. By preloading feeder trays and performing stacks, a time between jobs (e.g., a down time) can be reduced or eliminated; thereby providing a high level of efficiency.

The feeding unit 130 can facilitate removal of substrate media from the feeder trays 120 so that the substrate media can be transported through a printing system. The feeding unit 130 can include a housing 132 having a door 134 and cavity 136 for receiving the stack 118 of feeder trays 120 supported by the base unit 110, and a substrate removal mechanism 138, such as vacuum feed head, friction retard unit, stalled roller unit, and the like, for removing substrate media from the feeder trays 120. The feeding unit 130 can also include sensors 140 for sensing various aspects of the feeder trays 120, such as a number of feeder trays 120 in the stack, whether the feeder tray at the top of the stack has been positioned for removal of the substrate media held thereby, etc.

For embodiments where the base 110 is independent of the feeding unit 130, the base unit 110 can be rolled into the cavity 136 and can be docked with respect to the feeding unit 130. For embodiments, where the base unit 110 and the feeding unit 130 are integrally formed, the base unit 110 can be configured as a drawer that can be pulled out from the cavity 136 or can be stationary within the cavity 136. To access the cavity 136, the door 134 of the feeding unit 130 may be opened. When the door 134 is closed, the feeding unit 130 can sense whether there are feeding trays 120 within the cavity 136 using at least one of the sensors 140. In some embodiments, the feeding unit 130 can sense a number of feeder trays 120 that are with the cavity 136 as well as other information about the feeder trays 120 and substrate media held thereby.

The substrate removal mechanism 138 is positioned towards or at the top end of the cavity 136 on an internal surface of the housing 132. When the feeding unit 130 senses that one of the feeder trays 120 in positioned so that substrate media held thereby can be removed, the substrate removal mechanism 138 to facilitate removal of the substrate media from the positioned one of the feeder trays 120 to satisfy a job requirement. For example, the feeder tray 121 at the top of the stack 118 of feeder trays 120 may be holding twenty (20) sheets of plain letter sized paper to satisfy an outstanding job. The substrate removal mechanism 138 can facilitate removal of the sheets of paper by removing one sheet of paper at a time from the top feeder tray 121 until the job is complete.

In some embodiments, the feeding unit 130 can include a tray separator 150 to separate the feeder trays 120 from the stack 118 and a used tray holder 154. For example, when a job has completed, the feeder tray 121 on top of the stack 118 can be removed by the tray separator 150, which can also discharge the feeder tray 121 from the feeding unit 130 via discharge path 152. The tray separator 150 can work in cooperation with the elevator module 116 to aid in the removal of the feeder tray 121. For example, the elevator module 116 can lower the stack 118 of feeder trays 120 and the tray separator 150 can lift the feeder tray 121 off of the stack 118 or the tray separator 150 can hold the feeder tray 121 in a fixed position and the elevator module 116 can lower the stack 118 of feeder trays 120 so that the feeder tray 121 is separated from the stack 118. The used tray holder 154 can receive the feeder trays 120 that are separated from the stack 118 and discharged from the feeding unit 130. The discharged feeder trays 120 can be stacked on the tray holder 154 so that the user can remove the discharged feeder trays 120 and reuse the discharged feeder tray for other jobs.

Figure 2:
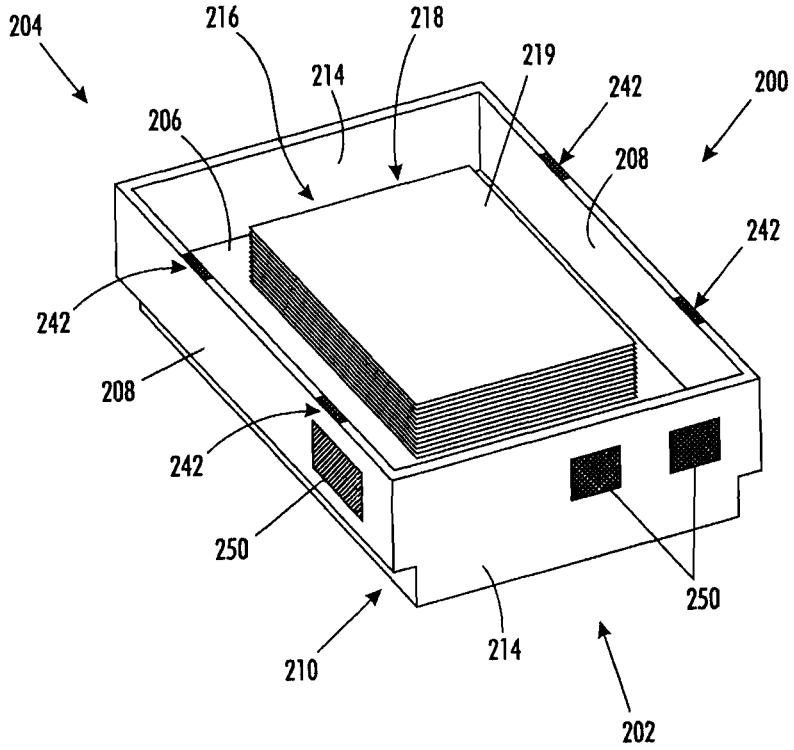
FIG. 2 is perspective view of a feeder tray of a composite feeding mechanism.
Figure 3:
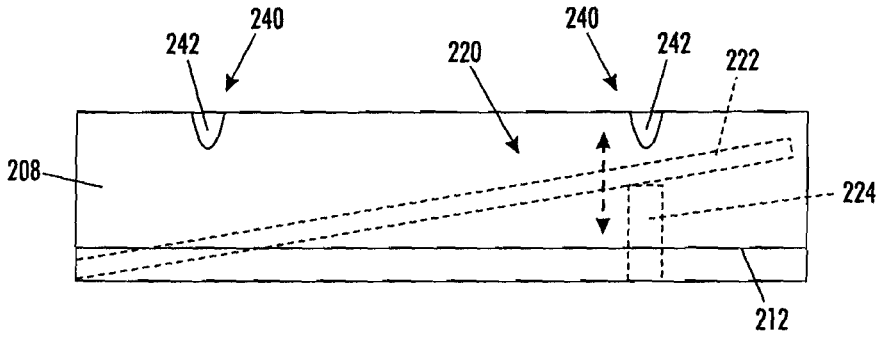
FIG. 3 is a side view of the feeder tray of FIG. 2.
Figure 4:
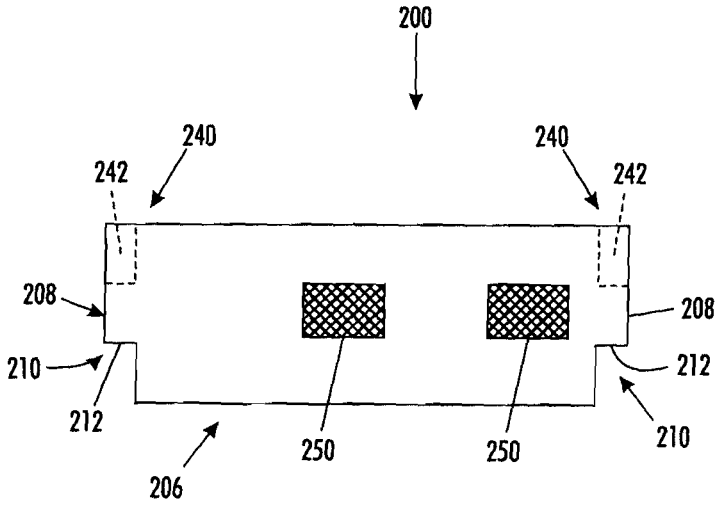
FIG. 4 is an end view of the feeder tray in FIG. 2.

FIGS. 2 through 4 depict an exemplary feeder tray 200 that can be implemented for one or more of the feeder trays 120 of FIG. 1. In some embodiments, the feeder tray 200 can have a generally rectangular configuration having a proximate end 202 and a distal end 204. The feeder tray 200 can have a broad bottom surface 206, side walls 208 and 214, and an open top portion 216 to form a compartment 218 for holding substrate media 219.

The side walls 208 and 214 can extend in a generally orthogonal direction from a perimeter of the broad bottom surface 206. The side walls 208 and 214 can be configured so that side walls 208 are opposingly spaced and side walls 214 are opposingly spaced. The side walls 208 can be contoured so that the side walls 208 have jog 210 forming a ridge 212 that can be substantially parallel to the broad bottom surface 206 and the side walls 214 can be substantially planar. The contoured side walls 208 provide an increased perimeter at the top open portion 216 of the feeder tray 200 compared to the perimeter defined by the broad bottom surface 206. When feeder trays are stacked, the ridge 212 formed by the contoured side walls 208 can rest on the top edges of corresponding side walls of another feeder tray so that the feeder trays are at least partially nested one within the other. In this manner, feeder trays in a stack rest on at least a portion of the feeder trays below them in the stack and a portion of the feeder tray including the broad bottom surface can extend into the compartment of a feeder on which it is stacked. As a result, the feeder tray 200 can be stacked in a stable configuration.

The feeder tray 200 can include a resiliently biased feeder plate 220 disposed at the bottom of the compartment 218 on the broad bottom surface 206 of the feeder tray 200 (FIG. 3). The resiliently biased feeder plate 220 can be composed of a substantially planar plate member 222 and a resilient member 224. The resilient member 224 can be disposed towards a proximate end of the feeder tray 200 so that the plate member 222 is biased at angle when there is no load (e.g., no substrate media 219) on the plate member 222 such that the plate member 222 and the broad bottom surface 206 are in close proximity at the distal end 204 and at the proximate end 220 the plate member 222 and broad bottom surface 206 are space further apart.

The top of the feeder tray 200 can be open to allow easy loading and removal of substrate media 219. When substrate media 219 is loaded into the compartment 218 of the feeder tray 200, the substrate media 219 can compress the resilient member 224 so that the plate member 222 moves closer to the broad bottom surface at the proximate end of the feeder tray 200 decreasing the slope of the ramp formed by the resiliently biased feeder plate 220. The resiliently biased feeder plate 220 can function to ensure that the substrate media 219 held by the feeder tray 200 is position in a manner that facilitates removal of the substrate media 219 by the substrate removal mechanism 138 (FIG. 1).

The feeder tray 200 can include a registering mechanism 240 that can interface with the one or more of the sensors 140 of the feeding unit 130. The registering mechanism 240 can be formed as openings 242, such as slots, holes, indents, or the like, formed in the feeder tray 200 for receiving one or more of the sensors 140. When one or more of the sensors 140 detect the registering mechanism 240, the feeding unit 130, based on a signal from one or more of the sensors 140, determines that the feeder tray 200 is suitably positioned to allow the feeding unit 130 to begin removing substrate media from the feeder tray 200.

The feeder tray 200 can include identifiers 250 disposed on one or more surfaces of the feeder tray 200. The identifiers 250 can provide information regarding the feeder tray 200 and the content of the feeder tray 200. For example, in some embodiments, the identifiers 250 can include indicia, colors, glyphs, bar codes, customer replaceable unit monitors (CRUMs), radio frequency identification (RFID) tags, other radio frequency devices, or other suitable mechanism for conveying information. The user can place one or more of the identifiers 250 on the feeder tray 200 and/or one or more of the identifiers 250 can be predisposed on the feeder tray 200 during manufacturing.

One or more of the sensors 140 can detect the identifiers 250 and can generate signals used by the feeding unit 130 to determine information about the feeder tray 200 and the contents of the feeder tray 200. For example, one of the identifiers 250 can provide information pertaining to the capacity of the feeder tray 200 (i.e. the amount of substrate media 219 can be held by the feeder tray 200), an amount of substrate media 219 placed in the feeder tray 200, a size of substrate media 219 being used (e.g., letter, A4, legal size, etc.), a type of substrate media 219 being used (e.g., bond paper, parchment, plain paper, photo paper, etc.), a job or run number, and the like. The feeding unit 130 can log the information obtained from the identifiers 250 to associate job processing information with a particular feeder tray, can use the information obtained from the identifiers 250 to queue jobs to be processed, and/or can use the information obtained from the identifiers 250 to determine a number of jobs remaining.

For example, in some embodiments, the identifiers 250 can be CRUMs. CRUM technology defines a process by which a state or status of consumable subsystems can be monitored to enhance the efficiency or productivity of a process. For embodiments where one or more of the identifiers 250 are CRUMs, the CRUMs can monitor and provide feedback to the composite substrate feeding mechanism pertaining to information about the feeder tray 200, such as an amount of substrate media remaining in a feeder tray 200, a type of substrate media loaded in the feeder tray 200, a location of the feeder tray 200 in the stack, and the like.

The CRUMs can include a memory device for storing the information about the feeder tray 200 and can be operatively connected with the one or more sensors of the feeding unit. Various electronic memory systems may be used in the CRUM including ROM, RAM, EEPROM, magnetic, optical, and the like. The information about the feeder tray 200 stored CRUM may be updated, for example, with a count of sheets removed from the feeder tray 200 by the feeding unit. For example, the CRUMs can be pre-programmed with a value corresponding to a total number of sheets of substrate media reflecting a maximum number of printouts that can be made generated using the feeder tray 200 and/or a value corresponding to a location in the stack. The value corresponding to the total number of sheets of substrate media can decline as each sheet is removed from the feeder tray 200. The value corresponding to the location in the stack can decline as feeder trays above the feeder tray 200 are removed from the stack.

In some embodiments, the identifiers can be RFID tags. An RFID tag refers to a device that can be disposed on an object and can communicate with other devices using RF signals, such as one or more of the sensors of the feeding unit, which can be RFID readers. The RFID tags can include an integrated circuit having memory that stores and/or a processor to process information, such as information about feeder trays, and that can modulate and/or demodulate an RF signal. The RFID tags can also include an antenna that propagates RF signals from the RFID tags and receives RF signals from other devices. The RFID tags may or may not include a power source to power the RFID tags.

For embodiments where one or more of the identifiers 250 are RFID tags, the RFID tags can be used to monitor and provide feedback to the composite substrate feeding mechanism pertaining to information about the feeder tray 200, such as an amount of substrate media remaining in the feeder tray 200, a type of substrate media loaded in the feeder tray 200, a location of the feeder tray 200 in the stack, and the like. The information about the feeder tray 200 stored in the RFID tag may be updated, for example, with a count of sheets removed from the feeder tray 200 by the feeding unit. For example, the RFID tags can be pre-programmed with a value corresponding to a total number of sheets of substrate media reflecting a maximum number of printouts that can be made generated using the feeder tray 200 and/or a value corresponding to a location of the feeder tray 200 in the stack. The value corresponding to the total number of sheets of substrate media can decline as each sheet is removed from the feeder tray 200. The value corresponding to the location of the feeder tray 200 in the stack can decline as feeder trays above the feeder tray 200 are removed from the stack.

FIGS. 5-8 depict an exemplary operation of the composite feeding mechanism 100 in a production printing system 500. The printing system 500 can include the feeding mechanism 100, a transport mechanism 502, a printing mechanism 504, and a finishing mechanism 506. Substrate media can be placed in one or more feeder trays 120 based on a job to be performed using the substrate media. For example, 30 sheets of blue letter sized paper can be placed in one feeder tray corresponding to a print job that requires at most 30 sheets of blue letter sized paper and another feeder tray can be loaded with 50 sheets of 3 inch by 5 inch white card stock paper corresponding to another print job. The feeder trays 120 can be stacked in an order corresponding to a job queue so that those of the feeder trays 120 corresponding to prints jobs at the beginning of the job queue are positioned towards the top of the stack 118 and those of the feeder trays 120 corresponding to print jobs at the end of the job queue are positioned towards the bottom of the stack 118. In some embodiments, the feeder trays 120 can include the identifiers 250 to associate the feeder trays 120 with the jobs in the queue.

Figure 5:
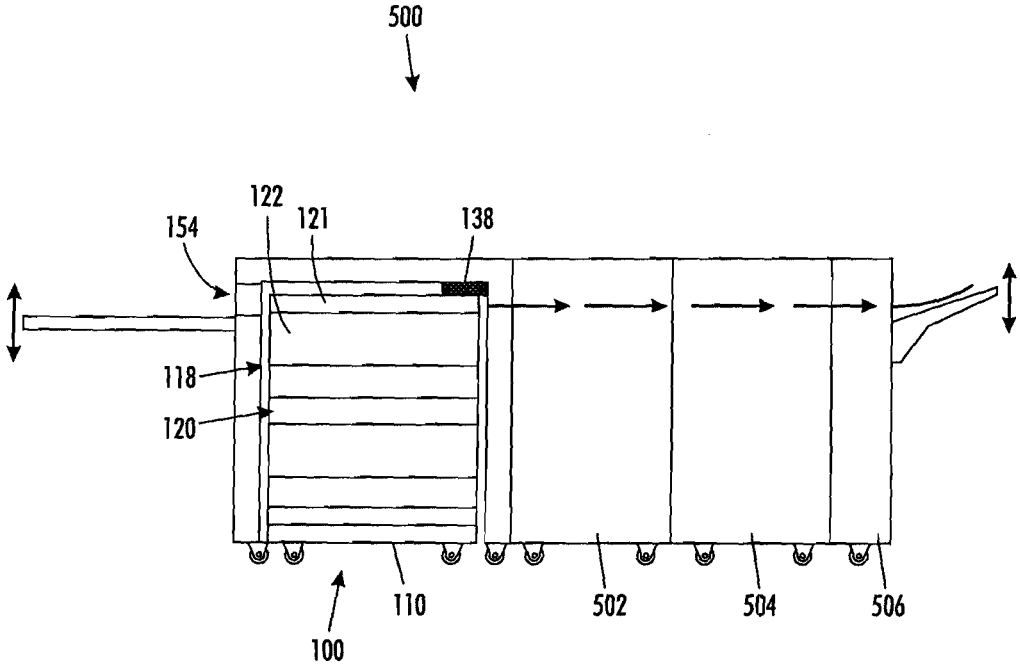
FIGS. 5-7 depict an operation of an exemplary of a composite substrate feeding mechanism.
Figure 6:
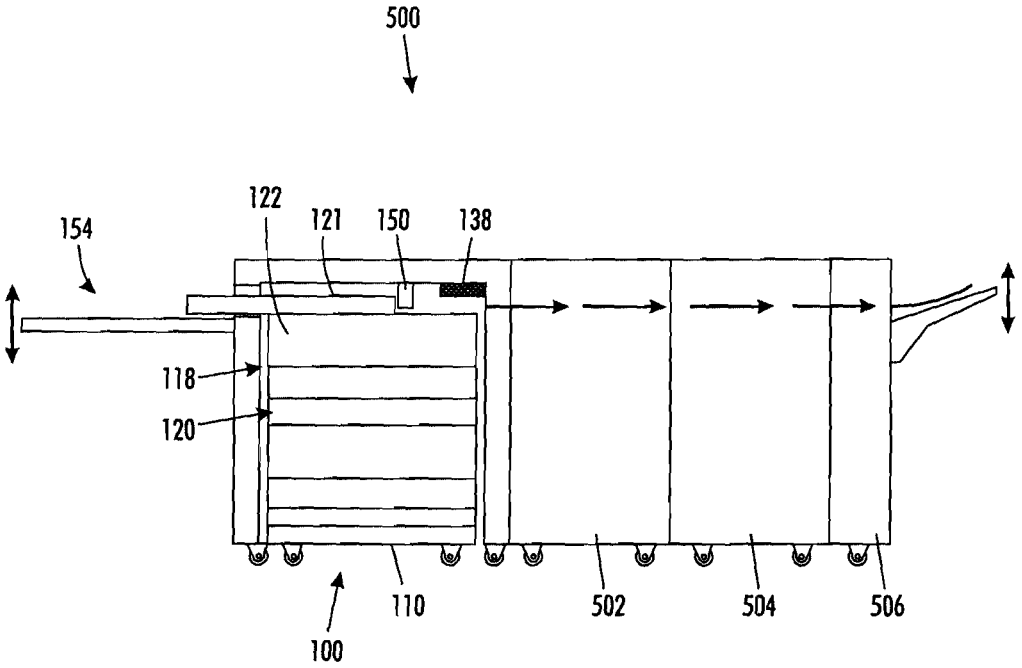
Figure 7:
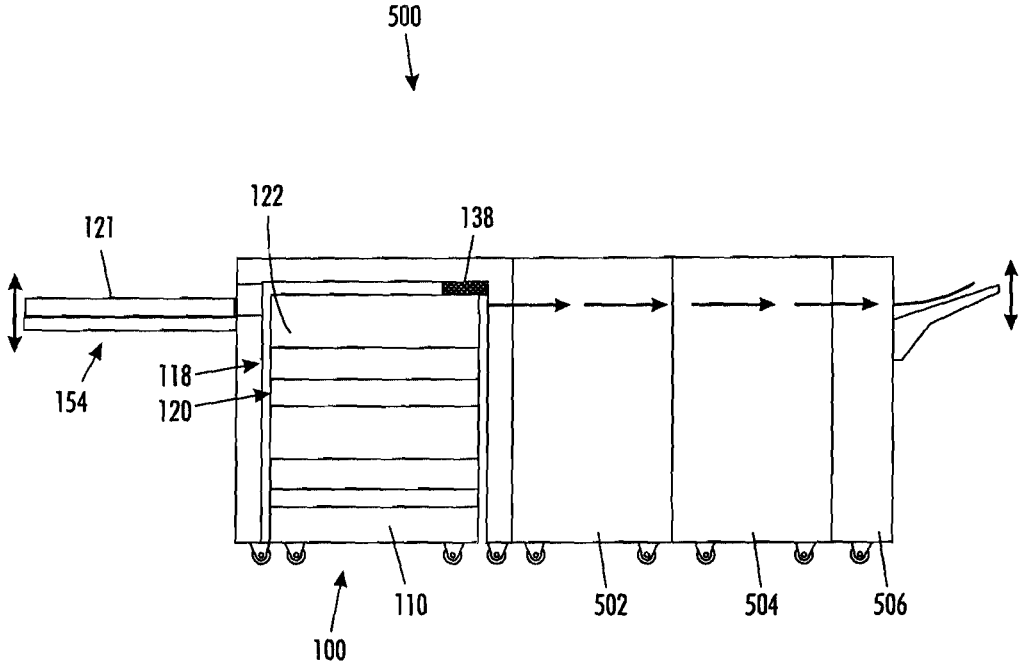

The feeder trays 120 can be stacked on the base unit 110 which can be moveably positioned with respect to the feeding unit 130 so that, for example, the base unit 110 can be moved into the cavity 136 of the feeding unit 130 (FIG. 5). The feeding unit 130 can sense the base unit 110 and feeder trays 120 and can be operatively connected to the base unit 110 to control the elevator module 116. The feeding unit 130 can sense the identifiers 250 on the feeder trays 120 to determine whether the feeder tray 121 at the top of the stack 118 corresponds to the print job to be performed. If not, the feeding unit 130 can alert the user that the correct feeder tray is not present. Otherwise, the feeding unit 130 can control the elevator module 116 to raise the feeder tray 121 at the top of the stack 118 into a position suitable for removal of the substrate media. The feeding unit 130 can sense when the feeder tray 121 is in the desired position based on the registering mechanism 240 and the job can begin. The substrate removal mechanism 138 of the feeding unit 130 can begin removal of the substrate media from the feeder tray 121.

The transport mechanism 502 can be operatively connected to the feeding mechanism 130 to receive the substrate media as it is being removed from the feeder tray 121. The transport mechanism 130 can function to transport the substrate media from the feeding mechanism 100 to the printing mechanism 504 in a sequential manner. The transport mechanism 502 may be formed from nip rollers, air fluffers, or other mechanisms known to those skilled in the art for transporting substrate media.

The printing mechanism 504 can be operatively connected to the transport mechanism 502 and can receive the substrate media from the transport mechanism 502. Once the printing mechanism 504 has received the substrate media, the printing mechanism 504 can use an electrostatographic process, a xerographic process, or other suitable process for printing information on the substrate media to produce printouts corresponding to the print job being processed, such as an ink jet process, liquid ink, solid ink, and the like.

The printouts can be sent through the finishing mechanism 506, which is operatively connected to the printing mechanism 504. The finishing mechanism 506 can perform one or more finishing operations specified in the print job, such as collating, hole punching, stapling folding, saddle-stitching or binding, inserting tabs or sheets between printouts, and the like. Once the finishing operations are completed the printouts are stacked by the finishing mechanism 506.

When the job is complete, the feeder tray 121, which may have some substrate media remaining therein can be removed from the feeding mechanism 130. In some embodiments, the feeder trays 120 are removed manually by the user. For example, when a job is complete, the printing system 500 may alert the user that the tray should be removed so that the next job in the queue can be started. The user can then open the door on the feeding unit 130 and remove the feeder tray 121 from the stack.

In other embodiments, the feeder tray 121 can be automatically removed from the feeding unit 130 when a job is complete. For example, upon completion of a job the feeding unit 130 can separate the feeder tray from the stack 118 using the tray separator 150 and can discharge the feeder tray through the discharge path 152 to the used tray holder 154, where the feeder tray 121 can be placed by the feeding unit 130.

After the feeder tray 121 has been discharged from the feeding unit 130, the feeding unit can operate the elevator module to again raise the stack 118 of feeder trays 120 so that the feed tray 122 is positioned for the next job. The printing system can repeat the above described process for feeder tray 122 and the remaining feeder trays 120 in the stack 118.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A composite feeding mechanism for a printing system comprising:

a plurality of feeder trays, each feeder tray having a bottom surface and sidewalls forming a compartment for holding sheets of a substrate media, the plurality of feeder trays being stackable to form a stack of feeder trays;

a base unit for supporting the stack of feeder trays, the base unit comprising an elevator module to change a vertical position of the stack of feeder trays; and a feeder unit for removing the substrate media sheet by sheet from a first one of the plurality of feeder trays located at the top of the stack of feeder trays to satisfy a print job, wherein one of the plurality of feeder trays include one or more registering mechanisms that interface with the feeder unit to facilitate removal of substrate media from the first one of the plurality of feeder trays.

2. The composite feeding mechanism of claim 1, wherein the feeder unit comprises:

a tray separator for separating the first one of the plurality of feeder trays in the stack from a remainder of the plurality of trays in the stack; and a discharge path through which the first one of the plurality of feeder trays is discharged from the feeder unit by the tray separator.

3. The composite feeding mechanism of claim 1, wherein one or more of the plurality of feeder trays are configured for a specific substrate media.

4. The composite feeding mechanism of claim 1, wherein one or more of the plurality of feeder trays can be adjusted to accommodate different substrate media.

5. The composite feeding mechanism of claim 1, wherein one or more of the plurality of feeder trays includes an identifier, the identifier associated with information regarding at least one of the one or more of the plurality of feeder trays and contents of the one or more of the plurality of feeder trays.

6. The composite feeding mechanism of claim 5, wherein the identifier is associated with at least one a type of substrate media, a size of substrate media, an amount of substrate media, and a location of one or more of the plurality of feeder trays in the stack.

7. The composite feeding mechanism of claim 5, wherein the identifier comprises at least one of a bar code, a customer replaceable unit monitor (CRUM), and a radio frequency identification (RFID) tag.

8. The composite feeding mechanism of claim 1, wherein a first one of the plurality of feeder trays in the stack rests on a second one of the plurality of feeder trays in the stack so that the first one of the plurality of feeder trays is at least partially supported by the second of the plurality of feeder trays.

9. The composite feeding mechanism of claim 8, wherein the first one of the plurality of trays includes a pair of contoured side wall having a jog that forms a ridge and the ridge rests on top edges of side walls of the second one of the plurality of feeder trays.

10. A printing system comprising:

a composite feeding mechanism configured to process one or more print jobs using a stack of feeder trays, at least one of the feeder trays having an identifier for identifying information regarding at least one print job to be satisfied by the at least one of the feeder trays, the identifier being at least one of a bar code, CRUM, and RFID tag, one of the feeder trays including one or more registering mechanisms that interface with a feeder unit configured to facilitate removal of substrate media from a top one of the plurality of feeder trays, the composite feeding mechanism configured to adjust a vertical position of the stack so that a top one of the feeder trays is selected to satisfy the at least one print job and to separate the top one of the feeder trays from the stack from a remainder of the feeder trays in the stack after the at least one print job is satisfied, the composite feeding mechanism further configured to discharge the top one of the feeder trays after the top one of the feeder trays is separated from the stack.

11. The printing system of claim 10, wherein a first one of the plurality of feeder trays in the stack rests on a second one of the plurality of feeder trays in the stack so that the first one of the plurality of feeder trays is at least partially supported by the second of the plurality of feeder trays.

12. The printing system of claim 10, wherein the composite feeding mechanism comprises:

a tray separator configured to separate the top one of the feeder trays in the stack from a remainder of the feeder trays in the stack; and a discharge path through which the top one of the feeder trays is discharged after the top one of the feeder trays is separated from the stack.

13. A composite feeding mechanism comprising:

a plurality of feeder trays being stackable so that adjacent feeding trays form a stack of feeder trays;

a base unit for supporting the stack of feeder trays; and a feeder unit for removing a substrate media sheet-by-sheet from a first one of the plurality of feeder trays located at the top of the stack of feeder trays to satisfy a print job, wherein one of the plurality of feeder trays include one or more registering mechanisms that interface with the feeder unit to facilitate removal of substrate media from the first one of the plurality of feeder trays, and one or more of the plurality of feeder trays includes an identifier, the identifier associated with information regarding at least one print job to be satisfied by at least one of the one or more of the plurality of feeder trays and content of the one or more of the plurality of feeder trays, and the identifier comprises at least one of a bar code, a customer replaceable unit monitor (CRUM), and a radio frequency identification (RFID) tag.

14. The composite feeding mechanism of claim 13, wherein the feeder unit comprises:

a tray separator for separating the first one of the plurality of feeder trays in the stack from a remainder of the plurality of trays in the stack; and a discharge path through which the first one of the plurality of feeder trays is discharged from the feeder unit by the tray separator.

15. The composite feeding mechanism of claim 13, wherein one or more of the plurality of feeder trays can be adjusted to accommodate different substrate media.

16. A composite feeding mechanism comprising:

a plurality of feeder trays for holding sheets of substrate media, the plurality of feeder trays being stackable on each other so that adjacent feeding trays form a stack of feeder trays, each of the feeder trays including a bottom surface and sidewalls forming a compartment in which the substrate is held;

a base unit for supporting the stack of feeder trays; and a feeder unit for removing the substrate media sheet-by-sheet from a first one of the plurality of feeder trays located at the top of the stack of feeder trays to satisfy a job, wherein one of the plurality of feeder trays include one or more registering mechanisms that interface with the feeder unit to facilitate removal of substrate media from the first one of the plurality of feeder trays, and a first one of the plurality of feeder trays in the stack of feeder trays is at least partially supported by a second one of the plurality of feeder trays.

17. The composite feeding mechanism of claim 16, wherein the first one of the plurality of trays includes a pair of contoured side walls, each having a jog that forms a ridge, and the ridge rests on top edges of side walls of the second one of the plurality of feeder trays.

18. A method for satisfying jobs in a printing system comprising:

adjusting a vertical position of a stack of feeder trays, each of the feeder trays having a bottom surface and side walls to form a compartment in which sheets of substrate media are placed, to facilitate removal of the sheets of substrate media from a top one of the feeder trays in the stack to satisfy a print job, one of the feeder trays including one or more registering mechanisms that interface with a feeder unit to facilitate removal of substrate media from the first one of the plurality of feeder trays;

removing the substrate media sheet-by-sheet from the top one of the feeder trays in the stack, the sheets of substrate media being used to generate printouts; and removing the top one of the feeder trays from the stack after the print job is satisfied to process a subsequent print job using a next one of the feeder trays, wherein removing the top one of the feeder trays comprises separating the top one of the feeder trays from the stack using a tray separator and placing the top one of the feeder trays on a used tray holder.

* * * * *